US011871882B2

(12) United States Patent
Raymond

(10) Patent No.: US 11,871,882 B2
(45) Date of Patent: Jan. 16, 2024

(54) SPACE CREATING SHOWER LINER WITH PLEATED WINDOW

(71) Applicant: Patrick Raymond, New York, NY (US)

(72) Inventor: Patrick Raymond, New York, NY (US)

( * ) Notice: Subject to any disclaimer, the term of this patent is extended or adjusted under 35 U.S.C. 154(b) by 188 days.

(21) Appl. No.: 16/958,989

(22) PCT Filed: Dec. 28, 2018

(86) PCT No.: PCT/US2018/067919
§ 371 (c)(1),
(2) Date: Jun. 29, 2020

(87) PCT Pub. No.: WO2019/133845
PCT Pub. Date: Jul. 4, 2019

(65) Prior Publication Data

US 2020/0329921 A1 Oct. 22, 2020

Related U.S. Application Data

(60) Provisional application No. 62/612,119, filed on Dec. 29, 2017.

(51) Int. Cl.
*A47K 3/38* (2006.01)
*A47H 13/02* (2006.01)
(Continued)

(52) U.S. Cl.
CPC ..... *A47K 3/38* (2013.01); *A47H 13/02* (2013.01); *A47H 13/16* (2013.01); *A47H 23/04* (2013.01)

(58) Field of Classification Search
CPC ..... A47K 3/38; A47H 13/02; A47H 13/16; A47H 23/04
See application file for complete search history.

(56) References Cited

U.S. PATENT DOCUMENTS 2,126,834 A * 8/1938 Steinberger ..... A47H 13/14 156/227
2,774,974 A 12/1955 Zaloga
(Continued)

FOREIGN PATENT DOCUMENTS

CA 1 272 439 A 8/1990
JP 2001218671 A 8/2001

OTHER PUBLICATIONS

International Search Report issued in corresponding PCT/US18/67919 dated Mar. 22, 2019.
(Continued)

*Primary Examiner* — Abe Massad
*Assistant Examiner* — John W Hanes, Jr.
(74) *Attorney, Agent, or Firm* — Troutman Pepper Hamilton Sanders LLP

(57) ABSTRACT

A space creating shower liner can have a window with a hoop fin rotatably and removably engaging a shower rod, a plurality of stiffening folds providing partial stiffness to the window, and a height less than a distance from the shower rod to a tub. Further, a liner can be removably engaged to the window, comprising a liner height less than the distance from the shower rod to the tub. The hoop fin causes the window and the liner to rotate about the shower rod, and the height and the liner height is greater than or equal to the distance from the shower rod to the tub.

7 Claims, 8 Drawing Sheets

(51) Int. Cl.
*A47H 13/16* (2006.01)
*A47H 23/04* (2006.01)

(56) References Cited

U.S. PATENT DOCUMENTS

| | | | | |
|---|---|---|---|---|
| 3,035,275 | A * | 5/1962 | Strebeigh | A47K 3/38 160/237 |
| 3,872,520 | A | 3/1975 | Tyconik | |
| 4,931,342 | A | 5/1990 | Tolbert et al. | |
| 5,007,120 | A * | 4/1991 | Annand | A47K 3/38 4/558 |
| 5,097,541 | A | 3/1992 | Annand | |
| 5,732,420 | A | 3/1998 | Micciche | |
| 5,771,504 | A | 6/1998 | Steiner | |
| 6,189,597 | B1 | 2/2001 | Cheng | |
| 6,336,232 | B1 | 1/2002 | Ellis | |
| 6,488,070 | B1 | 12/2002 | Cox | |
| 6,996,862 | B1 * | 2/2006 | Shippy | A47K 3/38 4/558 |
| 7,350,244 | B1 | 4/2008 | Handley | |
| 8,122,531 | B2 | 2/2012 | Li | |
| D655,552 | S | 5/2012 | Beyda | |
| D655,553 | S | 5/2012 | Beyda | |
| 9,603,491 | B2 * | 3/2017 | Royal | A47K 3/38 |
| 10,278,548 | B2 | 5/2019 | Raymond | |
| 2008/0178423 | A1 * | 7/2008 | Patel | A47K 3/38 16/87.2 |
| 2013/0067704 | A1 * | 3/2013 | Raymond | A47K 3/38 24/716 |
| 2013/0180670 | A1 | 7/2013 | Judkins | |
| 2014/0101842 | A1 | 4/2014 | Tsibulevskiy | |
| 2014/0298581 | A1 | 10/2014 | Chenoweth | |
| 2015/0135426 | A1 | 5/2015 | McFall | |
| 2016/0106251 | A1 | 4/2016 | Ramey | |
| 2016/0143486 | A1 | 5/2016 | Tsibulevskiy | |
| 2016/0220076 | A1 | 8/2016 | Haas | |
| 2017/0290468 | A1 | 10/2017 | Raymond | |
| 2018/0020861 | A1 * | 1/2018 | Beyda | A47H 23/00 160/124 |
| 2019/0254487 | A1 | 8/2019 | Raymond | |
| 2020/0077830 | A1 | 3/2020 | Song | |

OTHER PUBLICATIONS

Extended European Search Report issued in European Patent Application No. 18 89 5392 dated Jul. 8, 2021.

Notice of Reasons for Refusal dated Nov. 1, 2022, from corresponding Japanese Application No. 2020-555737.

* cited by examiner

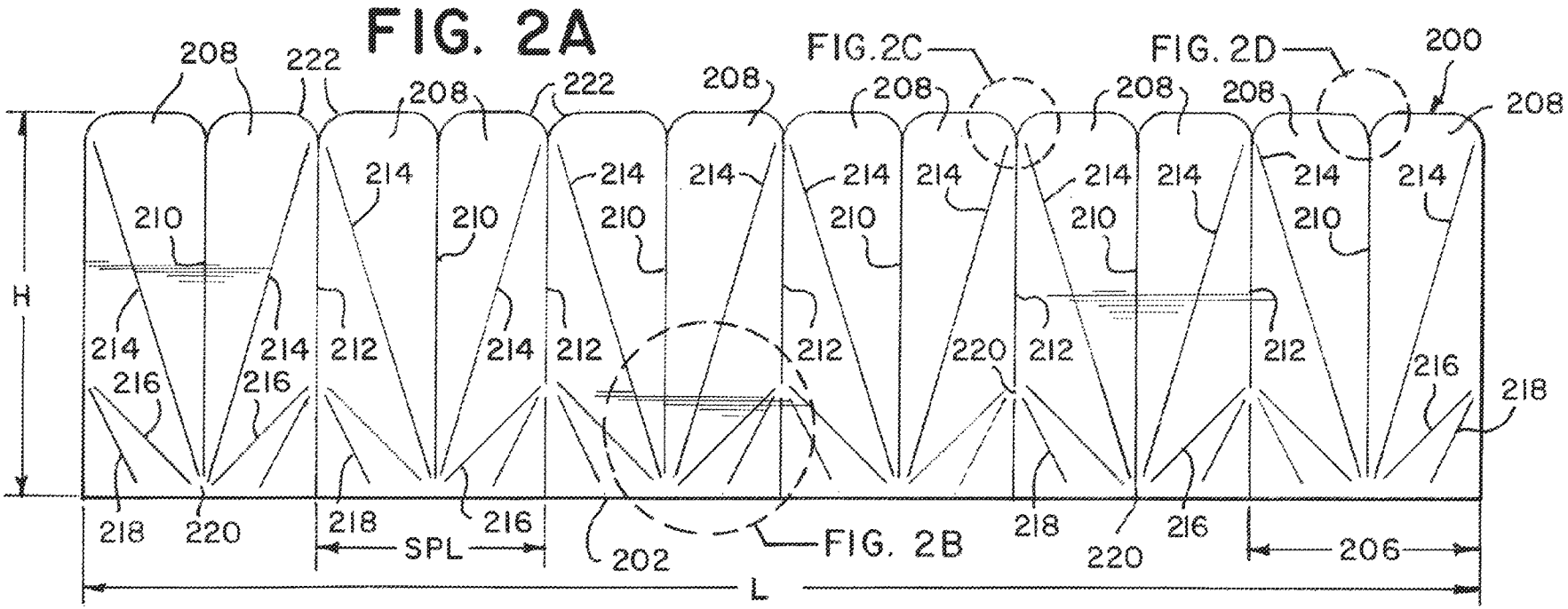
FIG. 2A
200
202
206
208
210
212
214
216
218
220
222
FIG. 2B
FIG. 2C
FIG. 2D
SPL
L
H
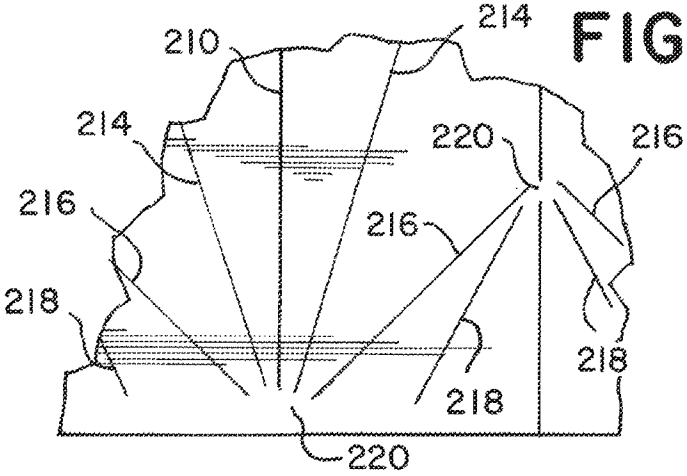
FIG. 2B
210
214
216
218
220
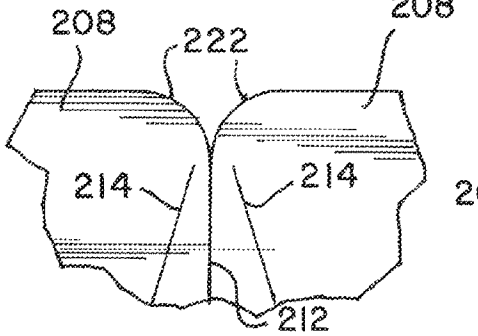
FIG. 2C
208
212
214
222
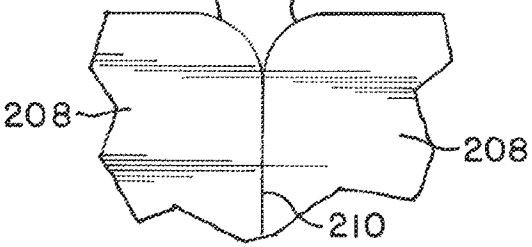
FIG. 2D
208
210
222

SPACE CREATING SHOWER LINER WITH PLEATED WINDOW

CROSS REFERENCE TO RELATED APPLICATIONS

This application is a U.S. National Phase Application under 35 U.S.C. § 371 of International Patent Application No. PCT/US18/67919, filed Dec. 28, 2018, which claims priority of U.S. Provisional Application 62/612,119 filed Dec. 29, 2017. The entire contents of which are hereby incorporated by reference.

FIELD OF THE INVENTION

The invention relates to a system designed to hold a shower liner away from the showering area while a person is taking a shower.

BACKGROUND

A shower curtain liner is frequently used to keep running water within a bathtub during a shower. A shower curtain liner typically has up to 12 grommet holes at the top, and it hangs from a set of up to 12 hooks that each engages with a grommet hole. The shower curtain liner hangs from a curtain rod installed above the shower head and above the outer edge of the bathtub. The shower curtain liner may share the hooks with a shower curtain, which is a second hanging layer that is frequently used for decorative or aesthetic purposes. The shower curtain typically is outside of the bathtub, and the liner remains inside the bathtub. Due to the flow of water and air during a shower, the shower curtain liner tends to swell inwardly toward the showering area, which is the area within a bathtub where a person stands during a shower. The shower curtain liner tends to swell inwardly and occupy space in the showering area. The shower curtain liner may also cling to the body of the person while taking a shower. This may provide an uncomfortable feeling for the person standing in the tub.

Prior solutions created stiff members with counterweights to hold the shower curtain liner away from the user. However, these solutions are bulky and expensive to manufacture, package and ship.

SUMMARY

A space creating shower liner can have a first element suspended from a fulcrum and having a weight. The first element can be the hoop fin in certain examples and the fulcrum can be the shower rod. The first element can have a fulcrum engaging portion rotatably and removably engaging the fulcrum and a plurality of stiffening folds providing partial stiffness to the first element. A liner can be suspended from the first element where the fulcrum engaging portion and weight causes the first element and the liner to rotate about the fulcrum. The space creating shower liner can also have a curtain disposed over at least one of the first element and the liner.

A different example of a space creating shower liner can have a window with a hoop fin rotatably and removably engaging a shower rod, a plurality of stiffening folds providing partial stiffness to the window, and a height less than a distance from the shower rod to a tub. Further, a liner can be removably engaged to the window, comprising a liner height less than the distance from the shower rod to the tub. The hoop fin causes the window and the liner to rotate about the shower rod, and the height and the liner height is greater than or equal to the distance from the shower rod to the tub.

BRIEF DESCRIPTION OF THE DRAWINGS

The above and further aspects of this invention are further discussed with reference to the following description in conjunction with the accompanying drawings, in which like numerals indicate like structural elements and features in various figures. The figures depict one or more implementations of the invention, by way of example only, not by way of limitation.

FIGS. 2A-2D illustrate the pleated window and magnified sections thereof.

DETAILED DESCRIPTION

Figure 1A:
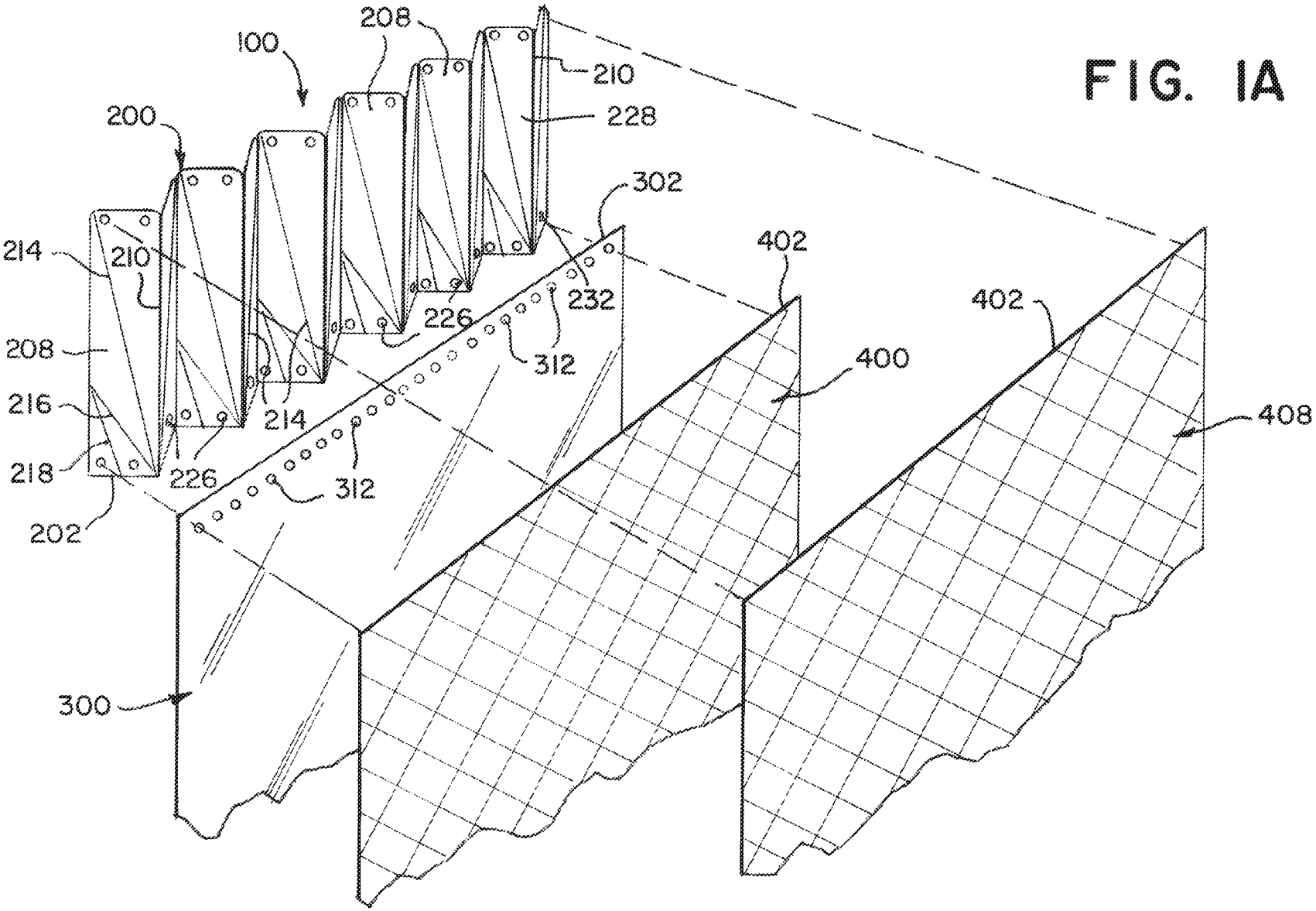
FIG. 1A illustrates an example of a space creating shower liner system with pleated window in exploded perspective of in a showering area.

FIG. 1A illustrates a space creating shower liner system 100 arrangement. A space creating shower liner system 100 can include a pleated window 200 and liner 300. Optionally, it can also have one or more curtains 400. One example of the system 100 is that the pleated window 200 hangs from the curtain rod 12. The pleated window 200 is not the entire length from shower rod 12 to the floor. Instead, a top 302 of the liner 300 attaches to a bottom 202 of the pleated window 200 and extends the rest of the length needed to stay in the tub 10 and prevent water from exiting the inside 14 of the tub 10. The bottom 304 of the liner 300 sits inside 14 the tub 10. Optionally, the curtain 400 can attach over the liner 300 at its top 402 and the curtain bottom 404 rests outside 16 of the tub 10.

Figure 1B:
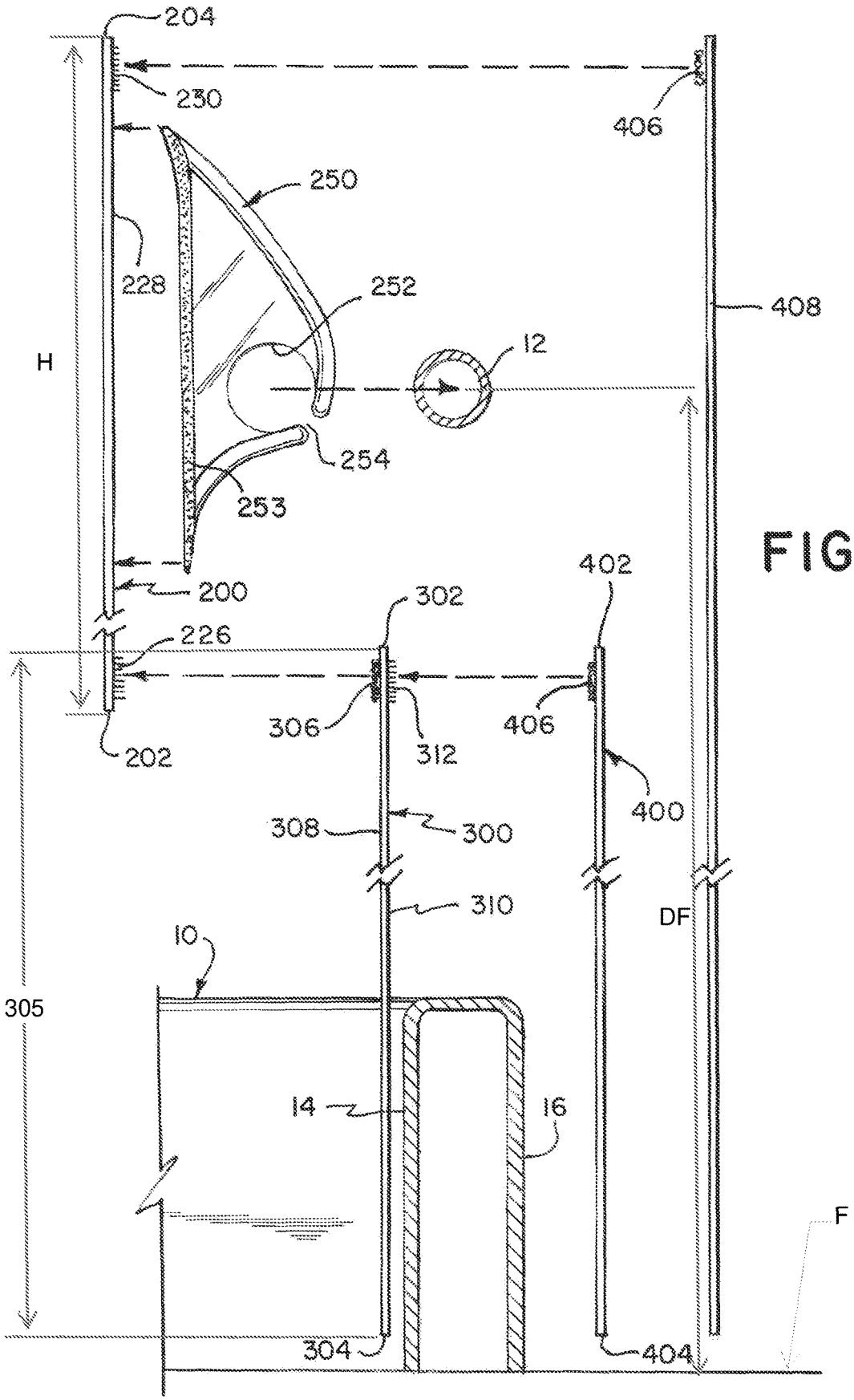
FIG. 1B illustrates a sideview of the space creating shower liner system thereof.

FIG. 1B illustrates a side view of the space creating shower liner system 100 that includes a tub 10, a shower head (not illustrated) and a shower curtain rod 12 that hangs above the tub 10 at about the edge of the tub 10. There is a shower side 14 of the tub 10 and the bathroom side 16. The pleated window 200 can have a top 204, bottom 202, and bathroom side 228. Attached to a bathroom side 228 of the window 200 are the hoop fins 250. FIG. 1B illustrates a single hoop fin 250. The hoop fins 250 extend toward the bathroom and have a partial hoop 252 formed therein. It is a partial hoop because there is a gap 254 formed in the hoop and/or fin 250, 252. The hoops 252 act to hang the system 100 from the shower rod 12. The liner 300 can have a top 302, a bottom 304, a shower side 308, and a bathroom side 310. The liner 300 can have a series of removably attachable fasteners 306 along the top 302. The fasteners 306 have mating fasteners 226 on the window 200. In one example, an inside 308 of the liner 300 can be attached to the bathroom side 228 of the window 200. This prevents water from entering the seam between the window 200 and liner 300 and leaving the shower area. The curtain 400 can have a top 402 and a bottom 404. The curtain 400 can be removably affixed to an outside 310 of the liner 300 using a separate set of removable fasteners 312 mating with the matching fasteners 406 on the curtain 400 or can attached to the window 200 with a bottom set 232 of fasteners. In another example of the curtain 408 can be attached near the top 204 of the window 200 using a top set 230 of fasteners or with the hoop fin 250.

FIGS. 2A-2D illustrate the pleated window 200. FIG. 2A illustrates a flattened length L of the window 200 and its height H. In one example, L can be about 78 inches and H about 22 inches. The window 200 can be constructed of a single sheet of material and formed into repeating panels 206. Each panel 206 is formed from mirror image subpanels 208. The subpanels 208 are mirrored over a mirror fold 210 and multiple panels 206 can be connected over a connecting fold 212. Each subpanel 208 has a series of internal peak folds that form the pleating to hold the system 100 away from the bather. Each subpanel 208 is the height H of the window but only a portion of its length L. In one example, the subpanels 208 are of equal length and there can be 12 of them, making a subpanel length SPL to be 1/12 of the window 200 length L, or SPL=1/12L. The subpanel length SPL can be taken from a mirror fold 210 to a connecting fold 212. In one example, the subpanel length is 6½ inches.

Each subpanel 208 can have a long fold 214 that extends approximately from the top 204 of the window 200 in one corner to approximately the bottom 202 of the window in the opposite corner of one subpanel 208. A first small fold 216 starts on the same side as the long fold 214 but at less than ½H from the bottom 202. In one example the first small fold 216 starts at about 6½ inches from the bottom 202. The first small fold 216 ends approximately at the mirror fold 210 near the bottom 202. A second small fold 218 can start approximately near the first small fold 214 on the same side and end at approximately the bottom 202 at a point approximately half the subpanel length SPL. The long and the first short fold 214, 216 typically end at the mirror fold 210 and are folded at an angle to the vertical mirror fold 210. Based on their start and end points each of the long and first and second short folds 214, 216, 218 have a different length and angle. In one example, the long fold 214 is approximately 22.9 inches long and at approximately 16.5° angle at the top 204, the first short fold 216 is approximately 9.2 inches long and at approximately 45° angle and the second short fold 218 is approximately 7.3 inches long and at approximately 26.7° angle.

FIGS. 2B and 2C are magnified views of the convergence of the folds near their start and end points. FIG. 2B illustrates the meeting of the long and first and second short folds 214, 216, 218, the mirror fold 210 and the connecting fold 212 near the bottom 202 of the window 200. FIG. 2C is the convergence of two tops of the long folds 214 near the top 204 of the window 200 and the connecting fold 212. As illustrated, in one example, none of the fold lines touch and/or intersect. There is a space 220 between any and all of the ends of the fold lines 210, 212, 214, 216, 218 so they never meet. This is one aspects of the invention, as it can keep stresses from forming and compromising the folds and also allows the folds to remain stiff to keep the window 200 and liner 300 suspended from the bather, as described below. Both FIGS. 2C and 2D also illustrate an example where the top 204 of each subpanel 208 has radiused corners 222.

Figure 3:
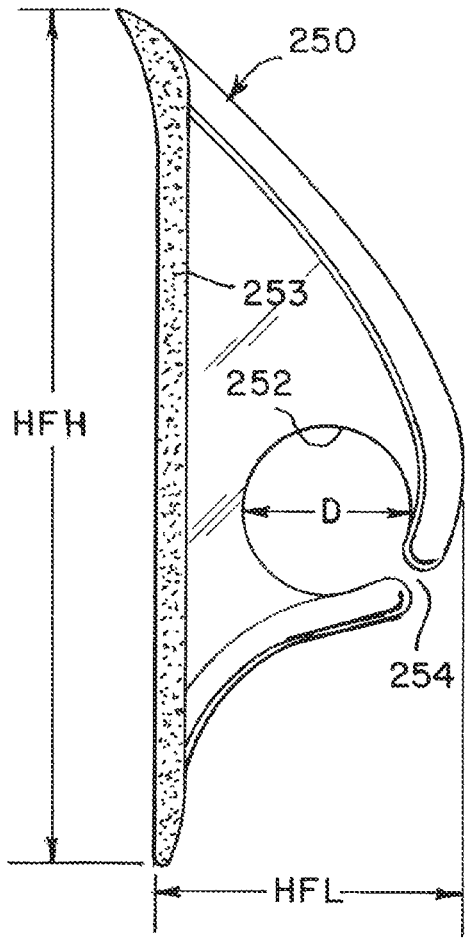
FIG. 3 illustrates a side view of the hoop fin.
Figure 4A:
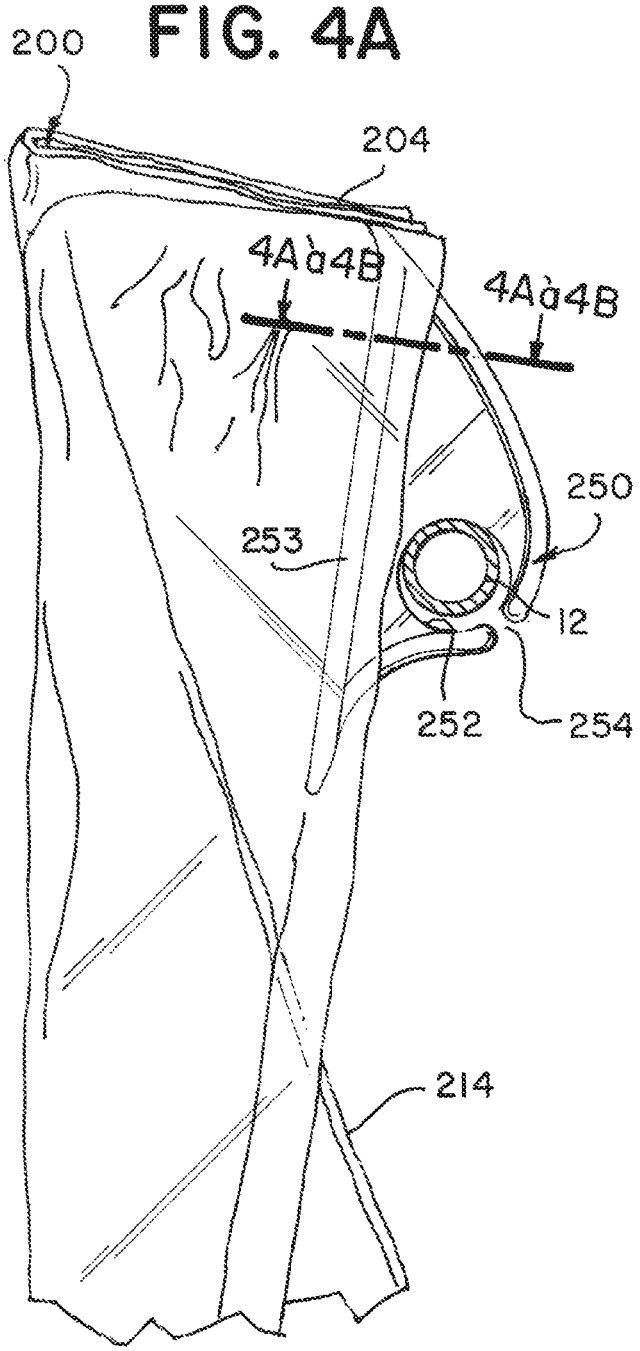
FIG. 4A illustrates a side view of the pleated window and hoop fin in a folded state.
Figure 4B:
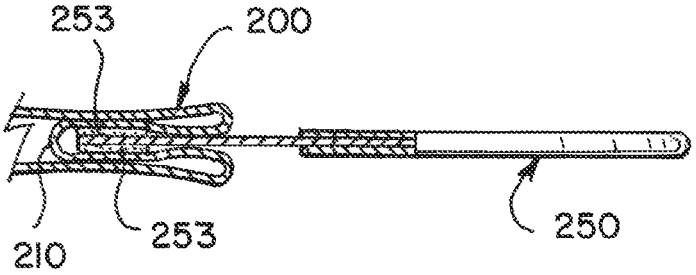
FIG. 4B illustrates a top view of the pleated window and hoop fin in a folded state.

In looking at the series of long folds 214, they form alternating triangles which fold in the middle by either a mirror or connecting fold 210, 212. Attached to a bathroom side 228 of the window 200 are the hoop fins 250, as illustrated in FIGS. 3 and 4. FIG. 3 illustrates a single hoop fin 250. The hoop fins 250 extend toward the bathroom 16 and have a partial hoop 252 formed therein. It is a partial hoop because there is a gap 254 formed in the hoop and/or fin 250, 252. The hoops 252 act to hang the system 100 from the shower rod 12. The hoop fins 250 are formed or attached at each mirror fold 210 and can be connected to or by the hoop fin back 253. Thus, in the six panel 206 example illustrated in FIG. 2A, there are six hoop fins 250. When the window 200 is completely folded along its length L, the fins 250 and hoops 252 line up, as illustrated in FIG. 4. The rod 12 is then passed through the gap 254 and rests in the hoop 252. Once the window 200 is unfolded, the hoops 252 maintain the system on the rod 12. The gaps 254, now no longer next to each other, do not allow the rod 12 to pass through. Note that the gaps 254 are passed from the shower side 14 of the rod 12 to the bathroom side 16, so that the fins are on the bathroom side 228 of the window 200.

The hoop fin 250 has a hoop fin height HFH of approximately less than half of the window height H, in one example the hoop fin height HFH is 8.5 inches. Further, the hoop fin 250 extends outward beyond the window 200 by a hoop fin length HFL, which can be approximately 3 inches. Furthermore, the hoop 252 can have a diameter D to fit over and easily slide along a shower rod 12. In one example the diameter can be approximately 1.5 inches.

Figure 5:
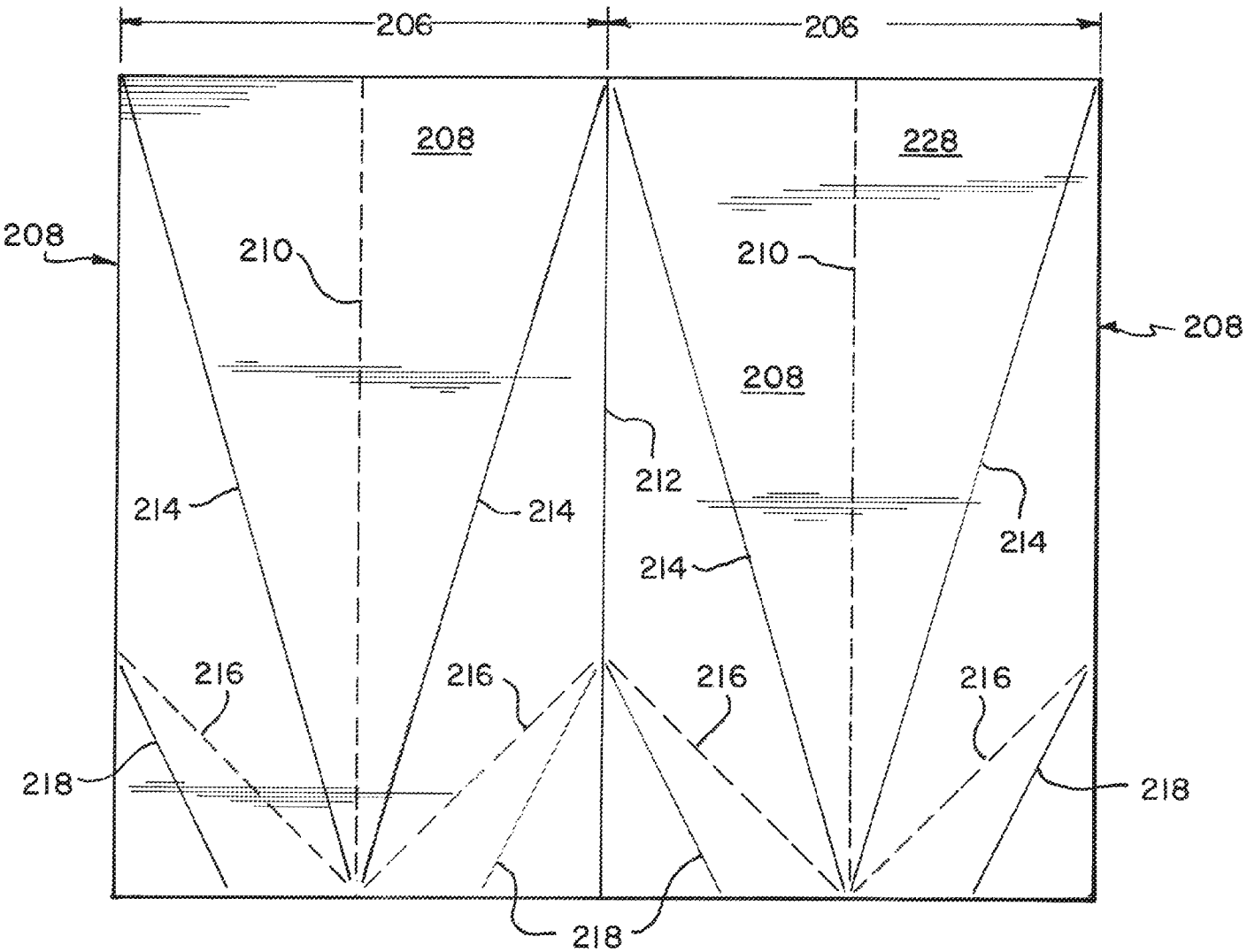
FIG. 5 illustrates an example of a folding pattern of the window from the bathroom side.

Turning back to the folds 210, 212, 214, 216, 218, the pattern of peak and valley folds are one of the key aspects of the invention and help move the system 100 out from the bather. FIG. 5 illustrates the fold patterns for two panels 206 using origami symbols. The dot-dash lines indicate mountain folds while the solid lines indicate valley folds. In the context of the invention and FIG. 5, the view is from the bathroom side 228 of the window 200, thus a mountain fold peak is toward the outside 16 of the shower and the valley fold is toward the inside 14 of the shower. The mirror fold 210 and the first short fold 216 are mountain folds while the connecting fold 212, the long fold 214, and the second short fold 218 are valley folds. To simplify the illustration, the spaces 220 and radiused corners 222 are not illustrated, but are present in examples of the invention.

Turning back to FIGS. 1A and 1B, the liner 300 and the curtains 400 are described below. The liner 300 can have a series of removably attachable fasteners 306 along the top 302. The fasteners 306 have mating fasteners 226 on the window 200. In one example, an inside 308 of the liner 300 can be attached to the bathroom side 228 of the window 200. This prevents water from entering the seam between the window 200 and liner 300 and leaving the shower area. However, there can be an attachment on the shower side 14, and flaps to cover the seam between the window 200 and liner 300. The liner 300 can be "shorter" than a standard liner because it is attached below the window 200. An example of the liner 300 of the present invention is that it is too short to reach from the rod 12 to the tub 10. FIG. 1B illustrates liner height 305 between top 302 and bottom 304. An example can have the liner height 305 less than a distance from the shower rod 12 to the tub 16. Another example can include the window height H and the liner height 305 is greater than or equal to a distance DF from the shower rod 12 to a floor F.

Turning next to the curtain 400, this is removably affixed to an outside 310 of the liner 300 using a separate set of removable fasteners 312 mating with the matching fasteners 406 on the curtain 400 or can attached to the window 200 with a bottom set 232 of fasteners. In another example of the curtain 408 can be attached near the top 204 of the window 200 using a top set 230 of fasteners or with the hoop fin 250. Thus, an example of the system 100 can include the window 200 and liner 300. Another example has the window 200, liner 300, and a semi-length curtain 400 which engages near the top 302 of the liner 300 or the bottom 202 of the window 200. A further example of the system 100 includes the window 200, liner 300, and a full-length curtain 408 which engages near the top 204 of the window 200 or on the hoop fin 250.

Now, to describe an example of the system 100 as whole, the window 200 engages and hangs from the rod 12 using the hoops 252. The placement of the hoop fin 250 plus a weight W of the window 200, act as counterbalances forcing the window 200 to pivot outward 216 away from the shower side 14 on the rod 12. The size of the hoop fin 250 and the placement of the hoop 252 in the fin 250 is what forms the leaver effect to pivot the window 200. The folds 210, 212, 214, 216, 218 form peaks and valleys to stiffen the window 200 which act to transfer the pivot force from the window 200 to one or more of the liner 300 and curtain 400.

Figure 6:
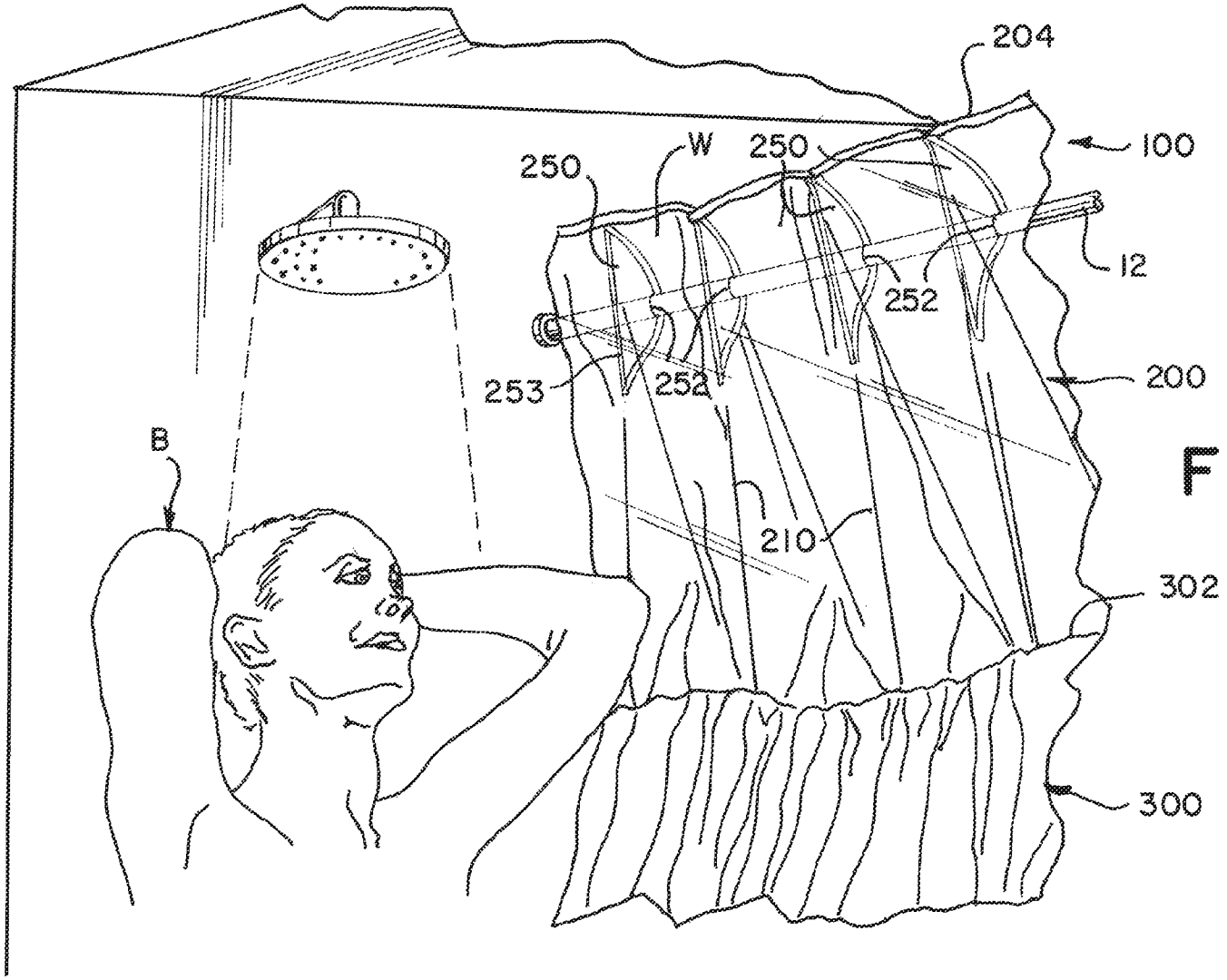
FIG. 6 illustrates the system suspended from a rod with a bather.

The window 200 height H is not long enough to reach the tub 10 when hanging from the rod 12. The liner 300, once attached to the window 200, provides the additional length so that the combination of the two 200, 300 have the height to prevent water from exiting the tub 10. A weight of the liner 300 does not "straighten" the pivot of the window 200, so the system 100 pivots outward from the bather. FIG. 6 illustrates the system 100 hanging from a rod 12 with a bather B. With the hoop fins 250 facing the outside 16 of the tub 10 the window 200 pivots toward the outside 16 as well. The top 302 of the liner 300 is also forced to pivot based on its attachment to the bottom 202 of the window 200.

The window 200 (which includes the hoop fin 250) can be made of any known flexible plastic, whether transparent, translucent, or opaque that meets the weight W to create the pivot effect for the system 100. The window 200 can be formed as a single sheet or multiple affixed panels 206, subpanels 208, or even triangular shapes as outlined by the folds 210, 212, 214, 216, 218. The liner 300 can be made of any known flexible plastic, fabric, or textile, whether transparent, translucent, or opaque, and is typically lighter than the window 200. The examples where the liner 300 is removably attached allow the user to remove and wash or replace the liner 300 while still keeping the window 200.

Figure 7A:
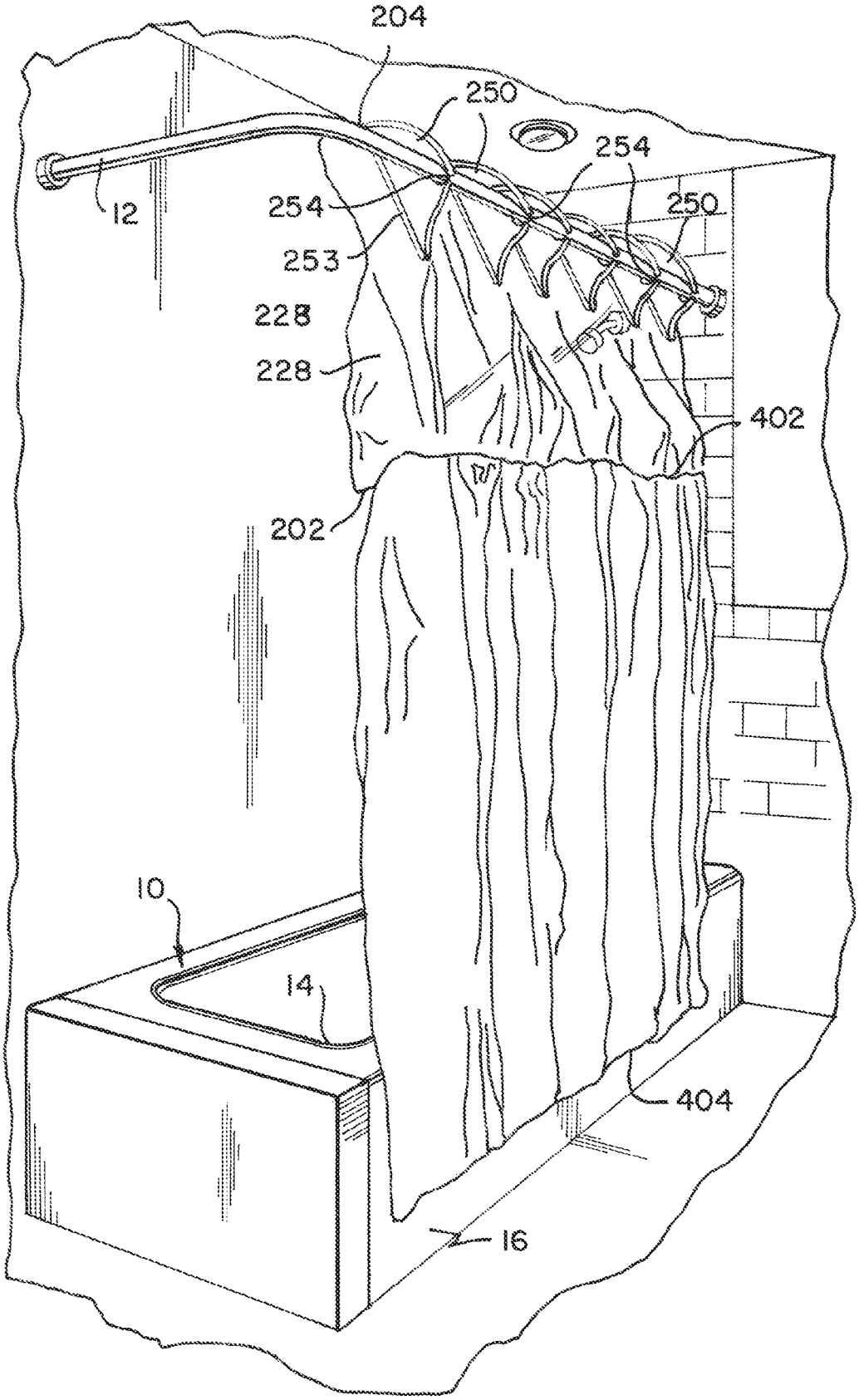
FIGS. 7A and 7B illustrate the system with a semi height curtain and a full height curtain, respectively.
Figure 7B:
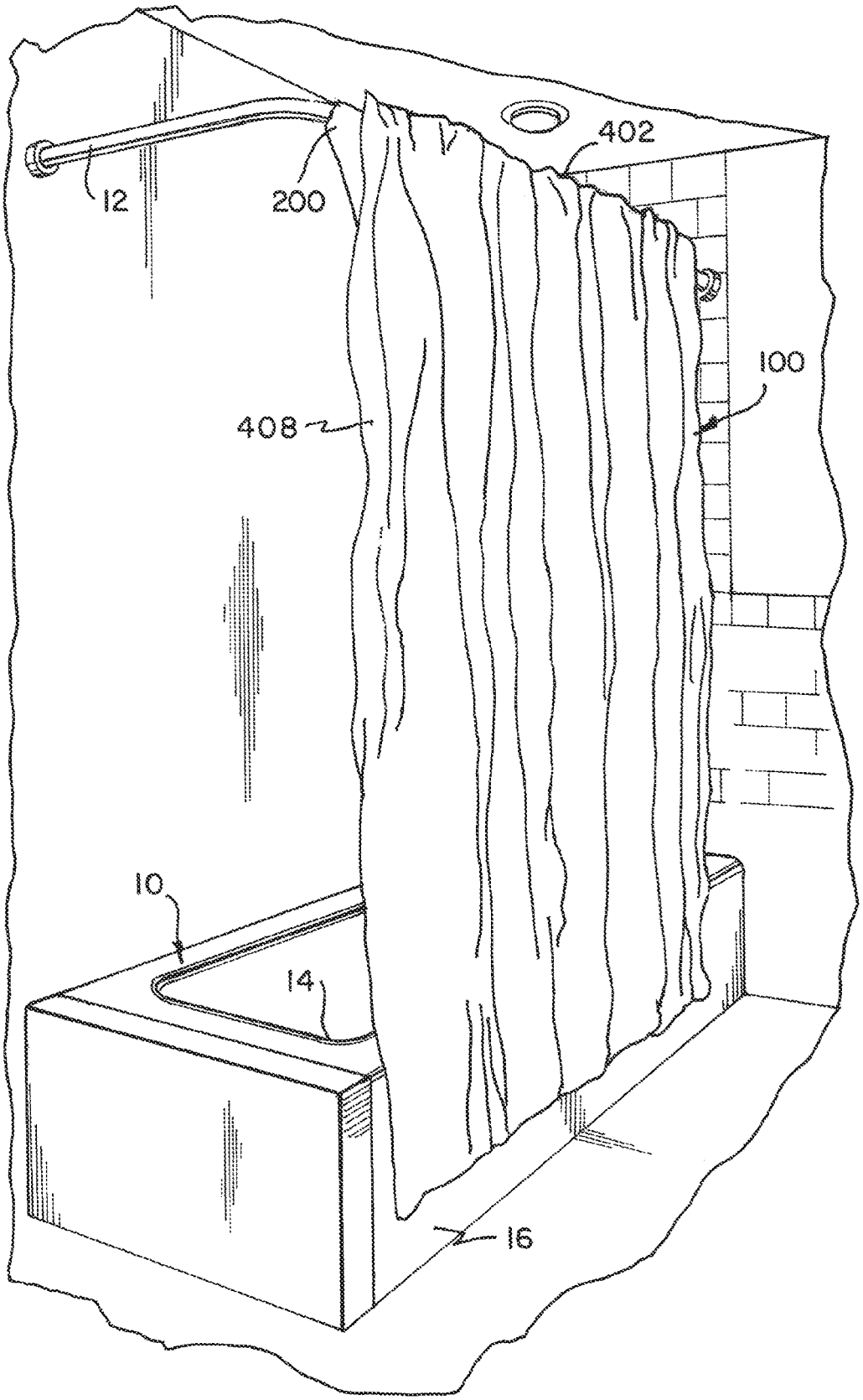

The curtains 400, 408 can be in semi or full height to either cover the liner 300 or both the window 200 and liner 300, respectively see FIGS. 7A and 7B. The curtain 400, 408 can be made of any flexible material including plastics or textiles. The curtain 400, 408 is typically decorative, opaque or translucent, and is also not designed to reside inside the tub 10.

In other examples, the folds 210, 212, 214, 216, 218 can be living hinges connecting particular shaped panels. Further, while the folds 210, 212, 214, 216, 218 are illustrated and described as linear, they can also be arcs approximating circles, ellipses or multiple straight segments thereof. In addition, in lieu of folds, external stiffening elements can be used. In particular semi rigid stiffeners can be placed along the fold lines. Alternately, air bladders can be formed, remaining flexible until pressurized and then stiffening with increased pressure.

The specific configurations, choice of materials and the size and shape of various elements can be varied according to particular design specifications or constraints requiring a system or method constructed according to the principles of the disclosed technology. Such changes are intended to be embraced within the scope of the disclosed technology. The presently disclosed embodiments, therefore, are considered in all respects to be illustrative and not restrictive. It will therefore be apparent from the foregoing that while particular forms of the disclosure have been illustrated and described, various modifications can be made without departing from the spirit and scope of the disclosure and all changes that come within the meaning and range of equivalents thereof are intended to be embraced therein.

What is claimed is:

1. A space creating shower liner comprising:
- a first element suspended from a fulcrum and having a weighted portion, comprising:
  - a fulcrum engaging portion rotatably and removably engaging the fulcrum; and
  - a sheet comprising a plurality of stiffening folds providing stiffness to the first element; and
  - a liner suspended from the first element,
  - wherein the fulcrum engaging portion and weighted portion causes the first element and the liner to pivot about the fulcrum outward from a shower side of the first element while hanging at rest such that the first element is oriented at an offset angle relative to a vertical direction.

2. The space creating shower liner of claim 1, further comprising:
- a curtain disposed over at least part of one of the first element and the liner.

3. The space creating shower liner of claim 1, further comprising:
- the fulcrum engaging portion is covered with a protective material.

4. A space creating shower liner comprising:
- a window having a weighted portion, comprising:
  - a hoop fin rotatably and removably engaging a shower rod comprising a shower side;
  - a plurality of stiffening folds providing stiffness to the window;
  - a height less than a distance from the shower rod to a floor; and
  - a liner removably engaged to the window, comprising a liner height less than the distance from the shower rod to the floor,
  - wherein the hoop fin and weighted portion pivot the window away from the shower side when at rest such that the window is oriented at an offset angle relative to a vertical direction, and
  - wherein the height and the liner height are greater than or equal to the distance from the shower rod to the floor.

5. The space creating shower liner of claim 4, wherein the pivoting of the window is about the shower rod.

6. A space creating shower liner comprising:
- a window, comprising:
  - a hoop fin rotatably and removably engaging a shower rod comprising a shower side;
  - a plurality of stiffening folds providing stiffness to the window;
  - a height less than a distance from the shower rod to a floor; and
  - a liner removably re-engageable to the window, comprising a liner height less than the distance from the shower rod to the floor,
  - wherein at least the hoop fin pivots the window away from the shower side when at rest such that the window is oriented at an offset angle relative to a vertical direction, and wherein the height and the liner height are greater than or equal to the distance from the shower rod to the floor.

7. The space creating shower liner of claim 6, wherein the pivoting of the window is about the shower rod.

* * * * *